US007107637B2

(12) United States Patent
Kuek et al.

(10) Patent No.: US 7,107,637 B2
(45) Date of Patent: Sep. 19, 2006

(54) SIDERAIL SUPPORT MECHANISM

(75) Inventors: Devin W. Kuek, Kalamazoo, MI (US); Nicholas S. Diamond, Mattawan, MI (US); Larry A. Wells, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 51 days.

(21) Appl. No.: 11/034,263

(22) Filed: Jan. 12, 2005

(65) Prior Publication Data

US 2006/0085912 A1 Apr. 27, 2006

Related U.S. Application Data

(60) Provisional application No. 60/622,503, filed on Oct. 27, 2004.

(51) Int. Cl.
*A47C 21/08* (2006.01)

(52) U.S. Cl. ..... 5/430; 5/428

(58) Field of Classification Search ..... 5/430, 5/425, 428, 427
See application file for complete search history.

(56) References Cited

U.S. PATENT DOCUMENTS

| | | | | |
|---|---|---|---|---|
| 3,932,903 | A | 1/1976 | Adams et al. | |
| 4,612,679 | A | 9/1986 | Mitchell | |
| 4,993,089 | A | 2/1991 | Solomon et al. | |
| 5,173,975 | A | 12/1992 | Peterson | |
| 5,604,942 | A | 2/1997 | Allevato et al. | |
| 5,678,267 | A | 10/1997 | Kinder | |
| 5,742,959 | A | 4/1998 | Froelich | |
| 5,781,945 | A | 7/1998 | Scherer et al. | |
| 6,058,531 | A | 5/2000 | Carroll | |
| 6,874,179 | B1 * | 4/2005 | Hensley et al. | 5/425 |
| 6,938,289 | B1 * | 9/2005 | Morin | 5/425 |
| 6,951,036 | B1 * | 10/2005 | Lemire | 5/425 |
| 7,028,352 | B1 * | 4/2006 | Kramer et al. | 5/425 |

* cited by examiner

*Primary Examiner*—Alexander Grosz
(74) *Attorney, Agent, or Firm*—Flynn, Thiel, Boutell & Tanis, P.C.

(57) ABSTRACT

A siderail support mechanism with multiple locks and an impact release feature is configured to positively lock in an upright deployed position, but is adapted to release upon imposition of a longitudinal impact load such as that caused by striking a stationary barrier.

39 Claims, 10 Drawing Sheets

SIDERAIL SUPPORT MECHANISM

CROSS-REFERENCE TO RELATED APPLICATION

This application claims priority under 35 U.S.C. §119(e) of provisional application Ser. No. 60/622,503 filed Oct. 27, 2004, the entire disclosure of which is herein incorporated by reference.

BACKGROUND OF THE INVENTION

1. Field of the Invention

The invention relates to support mechanisms for hospital bed siderails. In one of its aspects, the invention relates to a locking mechanism for siderail support mechanisms. In another of its aspects, the invention relates to a siderail support mechanism with an impact release feature.

2. Description of Related Art

Four-bar link siderail support mechanisms require being locked in various positions. It is important that the siderail stay locked for patient safety.

It is also known that patients are transported throughout the hospital on beds with siderails in the upright deployed position. Occasionally, the bed will come too close to the side of a door opening, causing the siderail to strike the doorjamb. This impact has the potential to damage either the bed or the doorjamb, or both.

It would be advantageous to provide a siderail locking mechanism that securely locks the siderail in the upright deployed position, but that is also capable of non-destructively releasing when struck by a longitudinal impact load such as that imposed by a collision with a stationary barrier during hospital transit.

BRIEF SUMMARY OF THE INVENTION

A siderail support mechanism with multiple locks and an impact release feature is configured to positively lock in an upright deployed position, but is adapted to release upon imposition of a longitudinal impact load such as that caused by striking a stationary barrier.

BRIEF DESCRIPTION OF THE SEVERAL VIEWS OF THE DRAWINGS

The present invention will become more fully understood from the detailed description and the accompanying drawings, wherein.

DETAILED DESCRIPTION OF THE INVENTION

Figure 1:
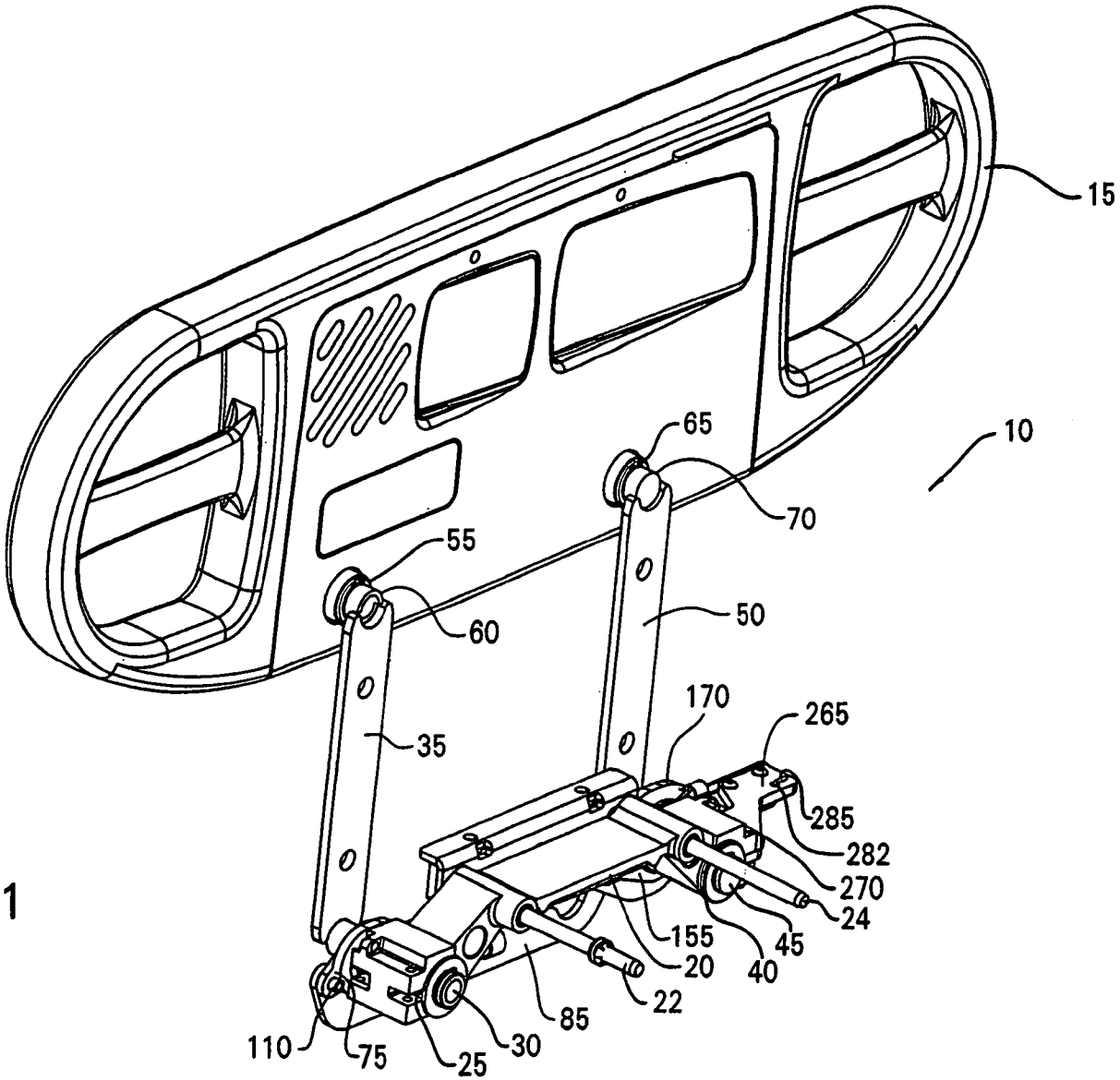
FIG. 1 is a perspective view of a siderail embodying a siderail support mechanism according to the invention.

Certain terminology will be used in the following description for convenience in reference only and will not be limiting. The words "up", "down", "right" and left" will designate directions in the drawings to which reference is made. The words "in" and "out" will refer to directions toward and away from, respectively, the geometric center of the device and designated parts thereof. The words "head" and "foot" will refer to the respective ends of a hospital bed, and the word longitudinal refers to an orientation parallel to a line running from the head to the foot of the bed. Such terminology will include derivatives and words of similar import.

Figure 2:
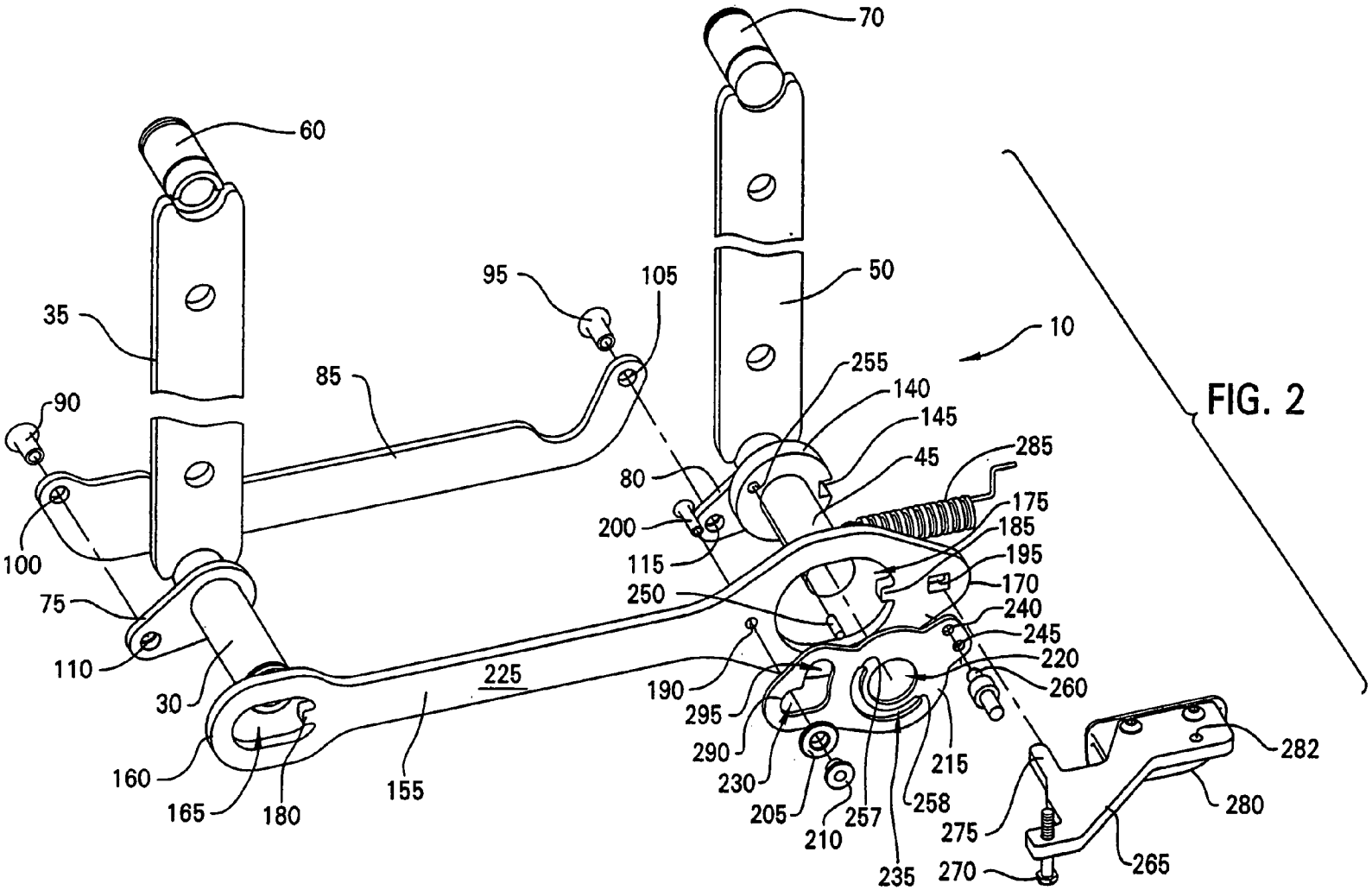
FIG. 2 is an exploded view of the siderail support mechanism of FIG. 1.

Referring to FIGS. 1–2, a siderail support mechanism 10 according to the invention is adapted to mount a bed guard or safety rail, hereinafter referred to as a siderail 15, to a bed support frame. The siderail support mechanism 10 includes a mounting bracket 20 for attachment to the bed support frame (not shown) by a pair of fasteners 22, 24. The mounting bracket 20 includes a first opening 25 adapted for receiving a first lower pivot shaft 30 of a first arm 35 and a second opening 40 adapted for receiving a second lower pivot shaft 45 of a second arm 50. The siderail 15 includes a first opening 55 for receiving a first upper pivot shaft 60 of the first arm 35 and a second opening 65 for receiving a second upper pivot shaft 70 of the second arm 50. The siderail first and second openings 55, 65 are spaced at a separation distance equal to the separation distance of the mounting bracket first and second openings 25, 40, and the first and second arms 35, 50 are equal in length, so that the siderail 15, the mounting bracket 20, and the first and second arms 35, 50 form a four-bar linkage.

As shown in FIG. 2, each of the first and second lower pivot shafts 30, 45 include a toggle 75, 80 affixed thereto and extending radially outwardly. The first and second lower pivot shafts 30, 45 are rotatably coordinated by a synchronization link 85 pivotally attached to each of the toggles 75, 80. The synchronization link 85 is secured to the toggles 75, 80 by pins 90, 95 passing through apertures 100, 105 in the synchronization link 85 and through apertures 110, 115 in the toggles 75, 80. The synchronization link 85 thereby forces the first and second arms 35, 50 to continue to rotate in the same direction as the siderail support mechanism 10 moves through its full range of motion.

Figure 3:
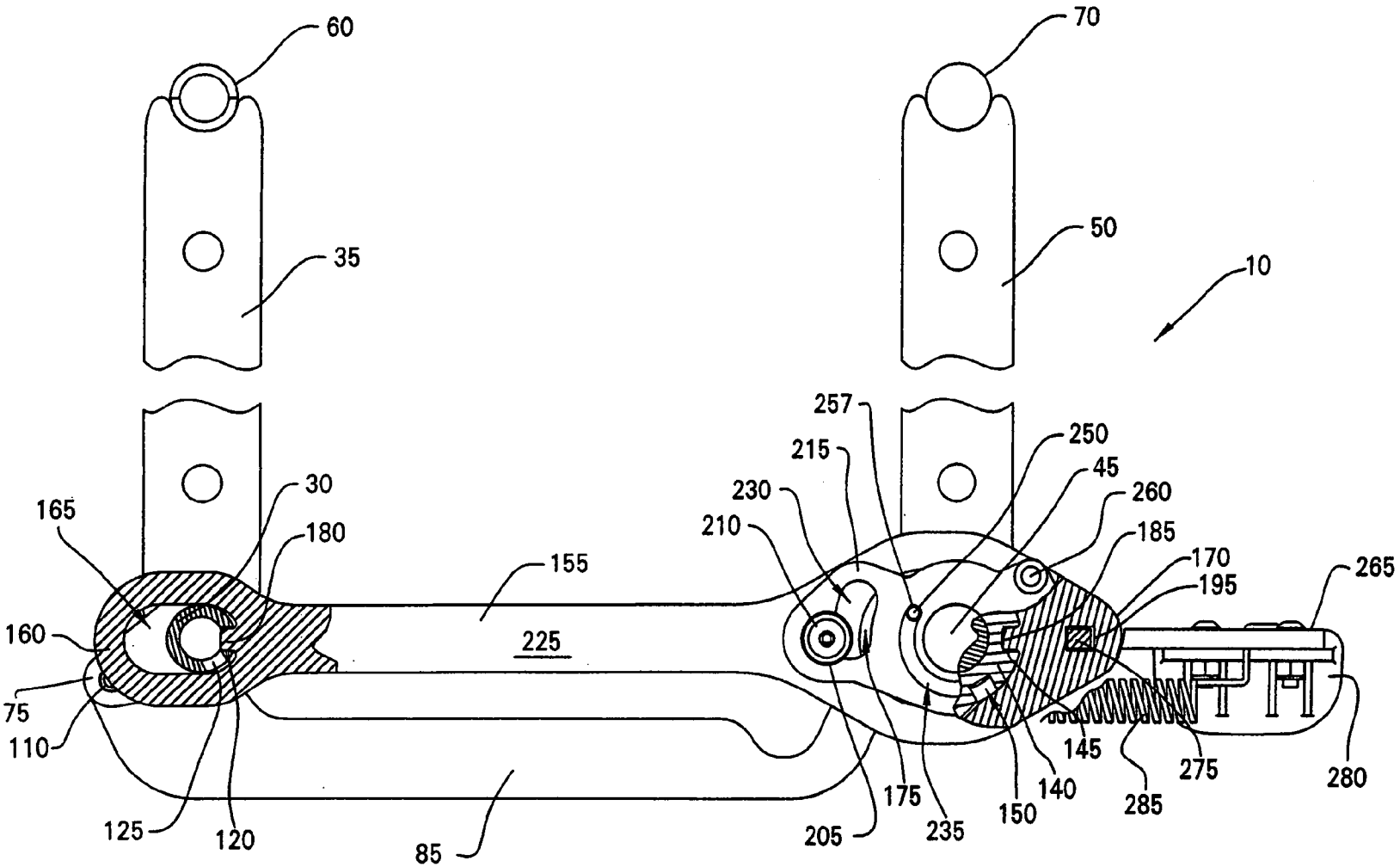
FIG. 3 is a partial cut-away view of the siderail support mechanism of FIGS. 1 and 2 in an upright, locked position.

The first lower pivot shaft 30 further includes a series of circumferentially spaced notches 120, 125 (see FIG. 3). The second lower pivot shaft 45 includes a collar 140 fixedly secured thereto and including a pair of notches 145, 150 rotationally corresponding to notches 120, 125 of the first lower pivot shaft 30.

The siderail support mechanism 10 further includes a "dog-bone" locking plate 155 having a first end 160 with an oblong aperture 165, and a second end 170 with an oblong aperture 175. The oblong aperture 165 at the first end 160 is configured with a minor axis substantially equal to the diameter of the first lower pivot shaft 30, the minor axis being transverse to the length of the dog-bone locking plate 155. The oblong aperture 175 at the second end 170 is configured with a minor axis substantially equal to a diameter of the collar 140 of the second lower pivot shaft 45. Each of the oblong apertures 165, 175 is configured with a major axis greater than its minor axis to enable longitudinal left-right movement of the locking plate 155 with respect to the first and second lower pivot shafts 30, 45. Each of the oblong apertures 165, 175 are further configured with an inwardly projecting locking cog 180, 185 adapted for engaging the notches 120, 125 and 145, 150 respectively. The second end 170 further includes a lockout pin aperture 190 and a lock release pin aperture 195. The lockout pin aperture 190 receives a lockout pin 200, which secures a washer 205 and bushing 210 to the locking plate 155 for cooperating with a bypass plate 215.

The bypass plate 215 includes a central shaft aperture 220 for receiving the second lower pivot shaft 45, and is adapted for slidably and rotatably lying flush against a face 225 of locking plate 155. The bypass plate 215 includes a L-shaped slot 230 for receiving the bushing 210, an arcuate indexing slot 235 concentric with the shaft aperture 220, and a pair of indexing detents 240, 245. The indexing slot 235 is configured for receiving an indexing pin 250 fixed in an indexing aperture 255 on the collar 140, and terminates in an upper extent 257 and a lower extent 258. The indexing slot 235 describes an arc of approximately 160 degrees. The indexing detents 240, 245 are circumferentially separated by approximately 20 degrees. The indexing detents 240, 245 are adapted for releasably receiving an indexing ball bearing 260 fixedly mounted to the mounting bracket 20 and spring biased for insertion in one of the indexing detents 240, 245.

A lock release lever 265 is pivotally mounted to the mounting bracket 20 by a pivot pin 270. The lock release lever 265 includes a lock release pin 275 received in the lock release pin aperture 195 in the second end 170 of locking plate 155. The lock release lever 265 further includes a lock release handle 280 configured for contact by an operator to release the locking plate 155. The lock release lever 265 includes an aperture 282 for receiving one end of a spring 285. The other end of the spring 285 is attached to the mounting bracket 20 for biasing the lock release lever 265 about the pivot pin 270. The lock release pin 275 thus urges the locking plate 155 toward a locked position wherein the locking cogs 180, 185 would be received by a pair of corresponding notches, such as the notches 120, 145.

Referring now to FIG. 3, the siderail support mechanism 10 is shown in the locked upright position. Each of the arms 35, 50 are substantially vertical, holding the siderail (FIG. 1) in its uppermost position. The locking plate 155 is in its leftmost, locked position, directed there by the lock release lever 265, which is biased by the spring 285. In this position of the locking plate 155, each of the locking cogs 180, 185 are received in their respective notches 120, 145. Bushing 210 is shown nested in a radially extending portion 290 (see FIG. 4) of the L-shaped slot 230. The indexing pin 250 is at the upper extent 257 of the indexing slot 235. The indexing ball bearing 260 is received in the indexing detent 245 when the siderail support mechanism 10 is in the full upright position.

Figure 4:
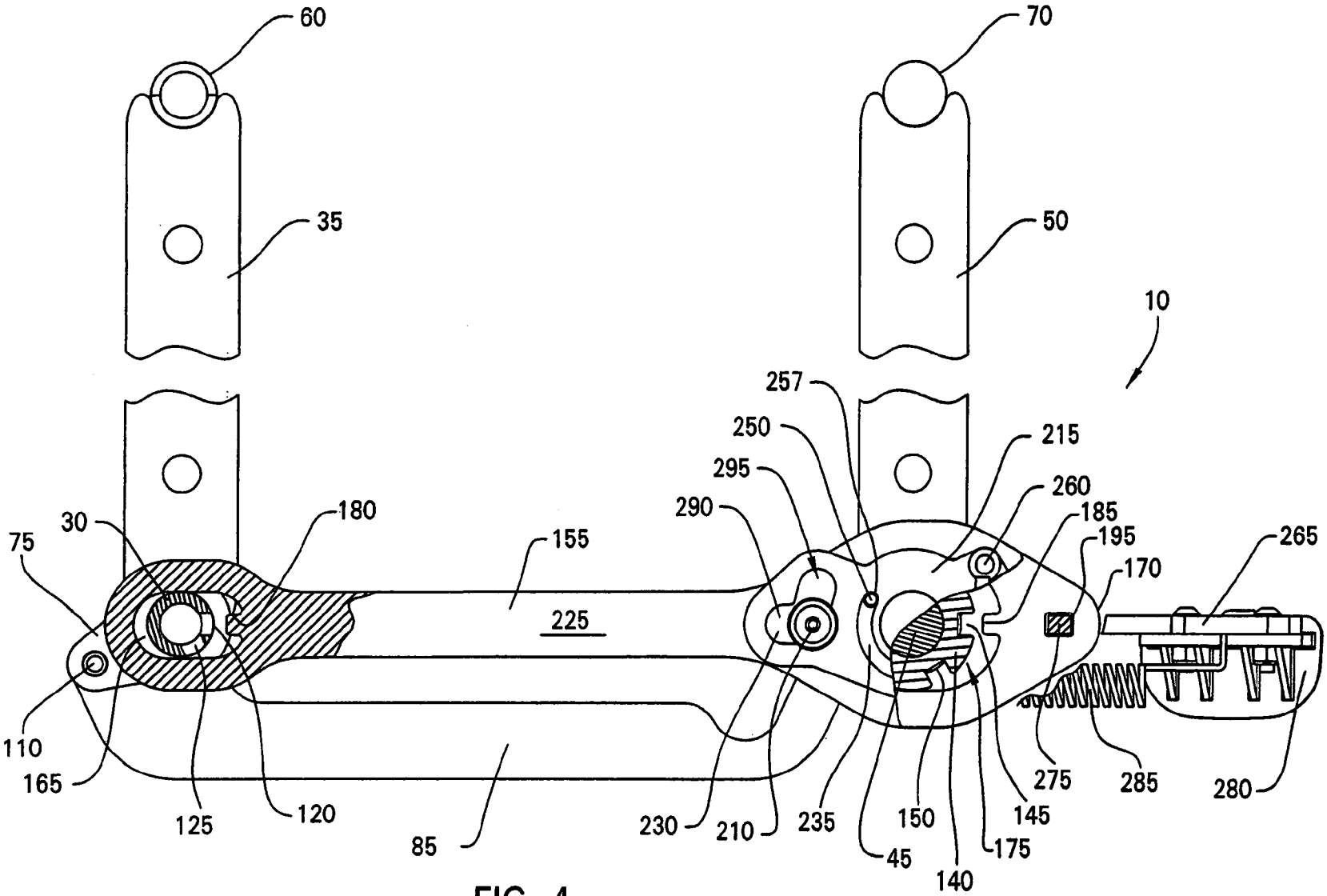
FIG. 4 is a partial cut-away view of the siderail support mechanism of FIGS. 1–3 in the upright, unlocked position.
Figure 5:
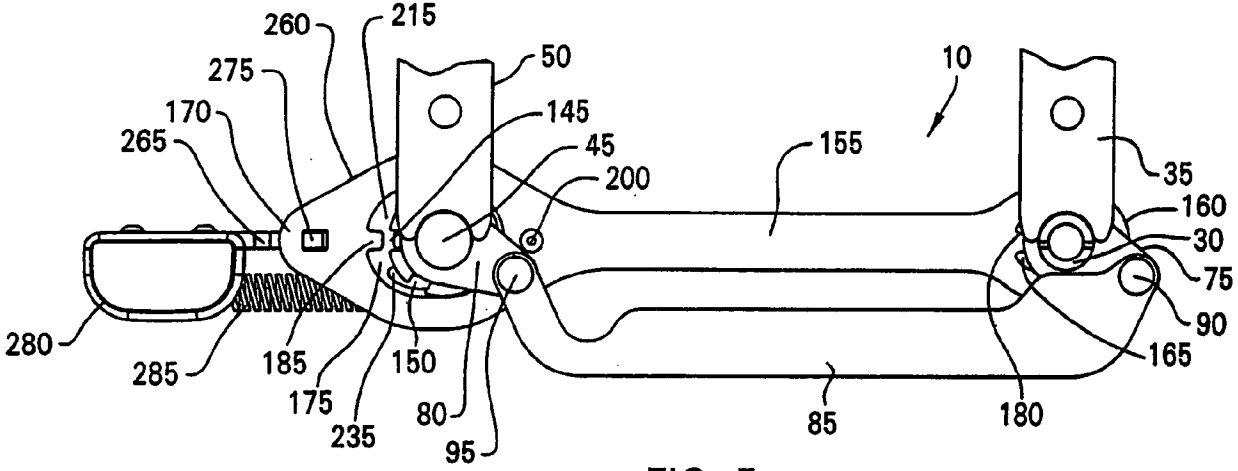
FIG. 5 is a front view of the siderail support mechanism of FIGS. 1–4 in the upright, unlocked position.
Figure 6:
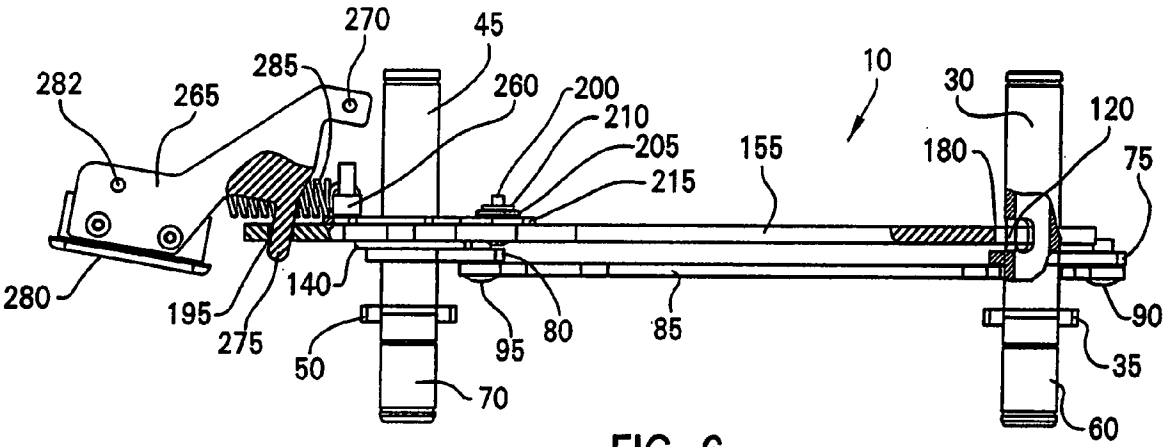
FIG. 6 is a partial cut-away top view of the siderail support mechanism of FIGS. 1–5 in the upright, unlocked position.

Referring to FIGS. 4–6, the siderail support mechanism 100 is upright, but the locking plate 155 is in an unlocked position. This is accomplished by the operator depressing lock release handle 280 to rotate the lock release lever 265 about the pivot pin 270 against the bias of the spring 285 (see FIG. 6). Referring to FIG. 4, as the lock release lever 265 is rotated about the pivot pin 270, the lock release pin 275 shifts to the right while inserted in the lock release pin aperture 195, drawing the locking plate 155 to the right. The locking cogs 180, 185 are withdrawn from the respective notches 120, 145. Simultaneously, the bushing 210, which is fixed to the locking plate 155, is moved from the radially extending portion 290 of the L-shaped slot 230 and into the crook of the "L", at the joint with a circumferential portion 295 of the L-shaped slot 230.

Figure 7:
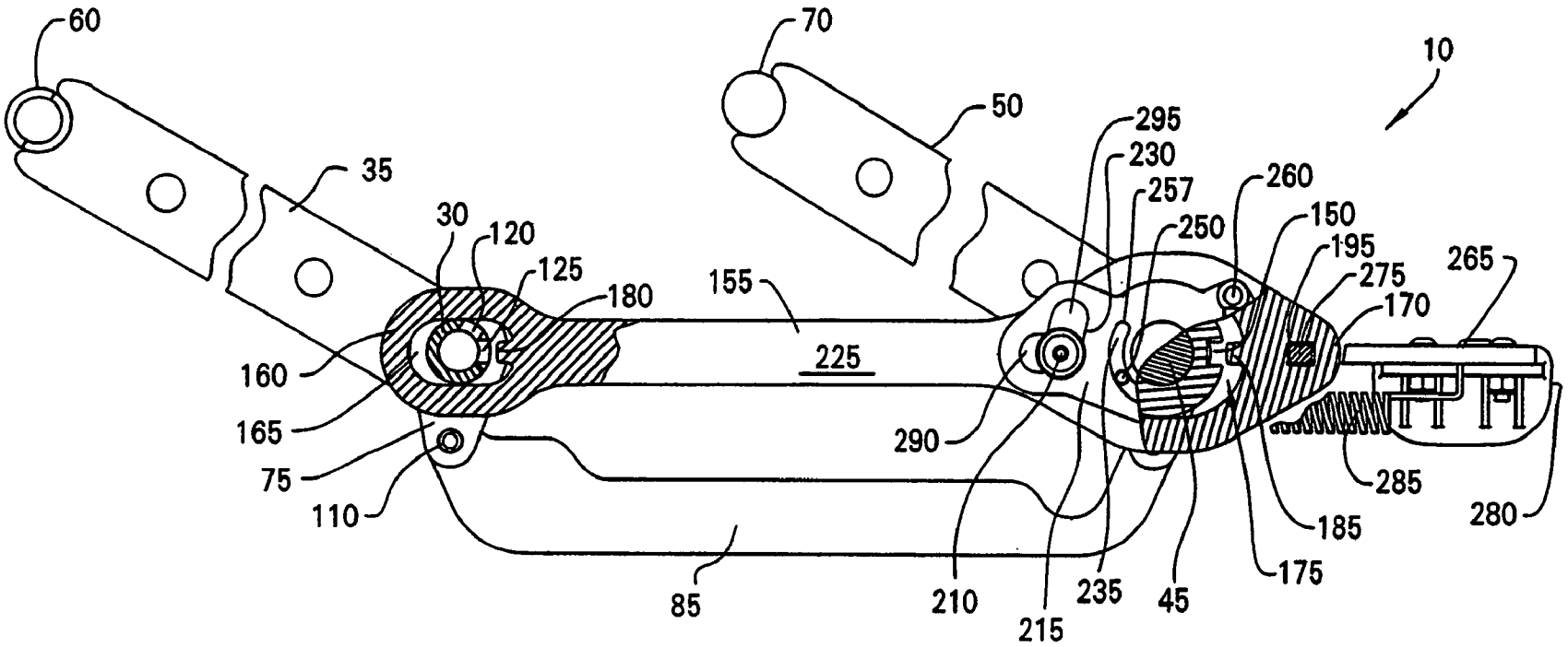
FIG. 7 is a partial cut-away view of the siderail support mechanism of FIGS. 1–6 in an intermediate height, unlocked position.
Figure 8:
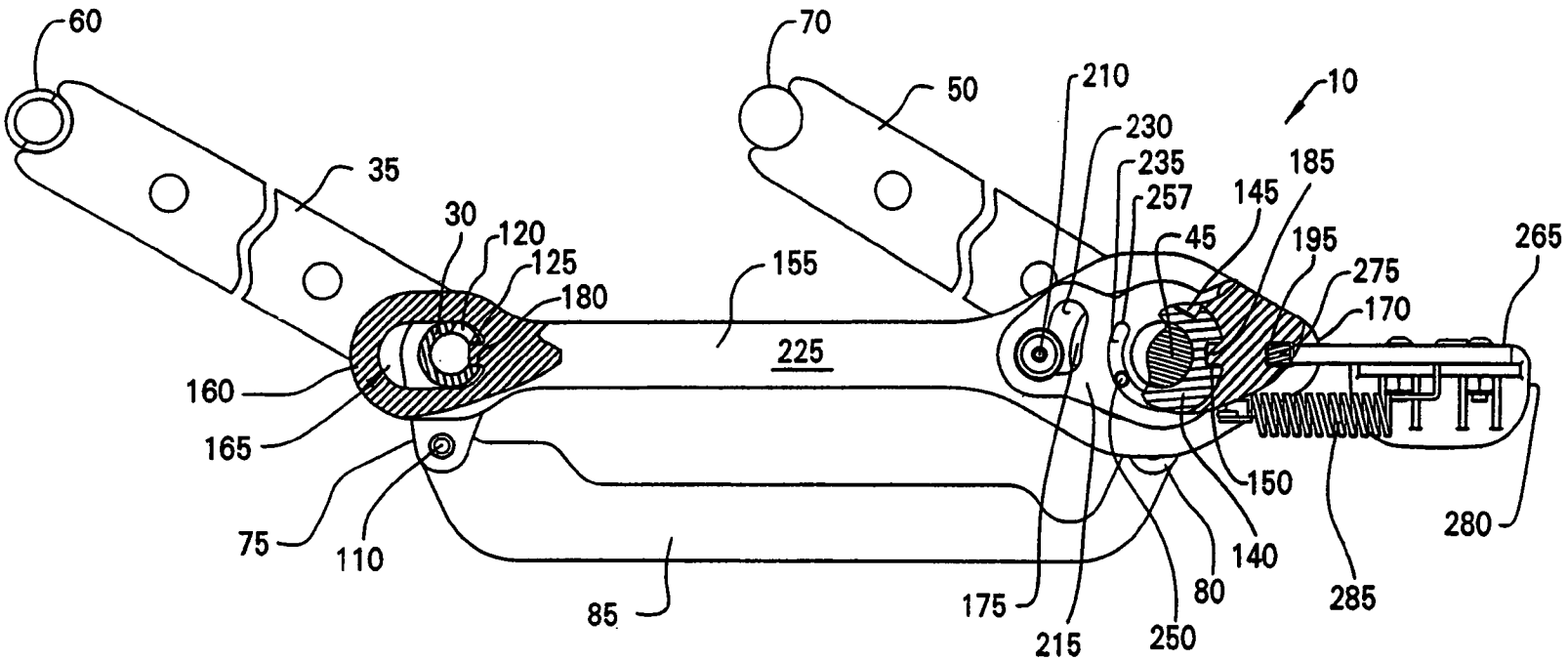
FIG. 8 is a partial cut-away view of the siderail support mechanism of FIGS. 1–7 in an intermediate height, locked position.

Referring now to FIGS. 7–8, the siderail support mechanism 10 is moved to a second deployed position lower than the position shown in FIGS. 3–6. With the locking plate 155 in the unlocked position of FIGS. 4–6, each of the arms 35, 50 is free to rotate about the axis of its respective lower pivot shaft 30, 45. The second deployed position of FIGS. 7–8 aligns the notches 125, 150 with the locking cogs 180, 185. If the operator releases the lock release handle 280, the lock release lever 265, under the bias of spring 285, can force the locking plate 155 back into the locked position shown in FIG. 8, with the locking cogs 180, 185 fully engaged in the respective notches 125, 150. The bushing 210, fixed to the locking plate 155, moves back into the radially extending portion 290 of the L-shaped slot 230.

Figure 9:
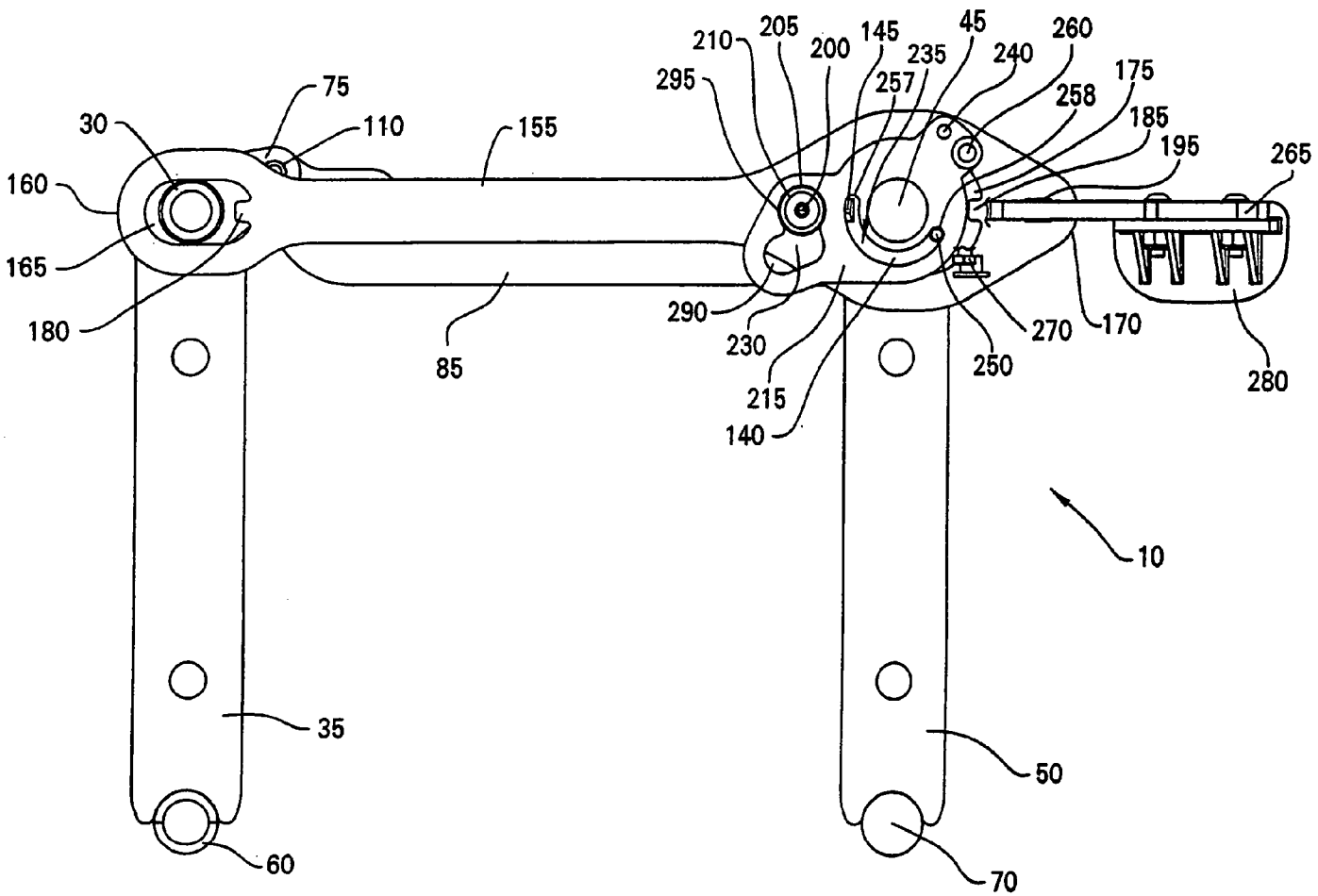
FIG. 9 is a rear view of the siderail support mechanism of FIGS. 1–8 in a lowered position.

Referring now to FIG. 9, the siderail support mechanism is shown in a lowered position, wherein the support arms 35, 50 depend from the lower pivot shafts 30, 45. The siderail support mechanism 10 is releasable to the lowered position by an operator depressing the release handle 280 to unlock the locking plate 155 and rotating the siderail support mechanism 10 until the notches 125, 150 have rotated past the locking cogs 180, 185. Once the notches 125, 150 have passed the locking cogs 180, 185, the siderail support mechanism 10 can rotate freely to the lowered position of FIG. 9.

As the siderail support mechanism 10 rotates to the lowered position of FIG. 9, the indexing pin 250 fixed to the collar 140 traverses the indexing slot 235 formed in the bypass plate 215. As the siderail support mechanism 10 approaches the lowered position, but before it is fully lowered, the indexing pin 250 reaches the lower extent 258 of the indexing slot 235. Further rotation of the siderail support mechanism 10 causes the indexing pin 250 to bear against the lower extent 258 of the indexing slot 235. The bypass plate 215 is normally held in rotational position by the indexing ball bearing 260 being received in the detent 240 on the bypass plate 215. As the indexing pin 250 bears against the lower extent 258 of the indexing slot 235, it forces the bypass plate 215 to rotate about the lower pivot shaft 45, forcing the indexing ball bearing 260 out of the detent 240. When the siderail support mechanism 10 reaches the fully lowered position, the bypass plate has rotated approximately 20 degrees. The indexing ball bearing is received in the detent 245, fixing the bypass plate 215 into a counter-clockwise rotated position. With the bypass plate 215 thus rotated, the L-shaped slot 230 is rotated so that the bushing 210 is received in the circumferential portion 295 of the L-shaped slot 230. The bushing 210 is fixed to the locking plate 155, so the locking plate 155 is prevented from moving to the left and returning to the locked position.

The locking plate 155 is held in the unlocked position until the bypass plate 215 is rotated clockwise to align the bushing 210 with the radial portion 290 of the L-shaped slot 230. This is accomplished when the siderail support mechanism 10 is returned to its full upright position (FIGS. 3–6), as the indexing pin 250 bears against the upper extent 257 of the indexing slot 235 to rotate the bypass plate 215 clockwise, shifting the indexing ball bearing 260 from the detent 245 back to the detent 240. In this way, the siderail support mechanism 10 does not "catch" in the intermediate position while the operator attempts to raise it to the full upright position, nor must the operator hold the lock release handle 280 while raising the siderail 15.

Referring now to FIGS. 10–13, a further embodiment of a siderail support mechanism 300 incorporating a "dog-bone" locking plate 302 is illustrated. The siderail support mechanism 300 is similar in function and method of attachment to the siderail 15 and bed frame of the first embodiment. FIGS. 10–13 illustrate only those differences found in locking plate 302 and its interaction with a first lower pivot shaft 305 and a second lower pivot shaft 310.

The first lower pivot shaft 305 includes a collar 315. The second lower pivot shaft 310 includes a collar 317. It should be well understood that the embodiment of the collars 315, 317 herein described together would be compatible for use individually or in combination with the collar 140 or notched lower pivot shaft 30 of the above-described embodiment.

The collars 315, 317 each include a first notch 320, 322, a second notch 325, 327 and a cutout section 330, 332. The locking plate 302 includes a pair of oblong apertures 335, 340 for receiving the collars 315, 317 respectively. Each of the oblong apertures 335, 340 are configured with a minor axis and a major axis, the minor axis being substantially equivalent to the diameter of the collar 315, 317 and extending transverse to a length of the locking plate 302. The oblong aperture 335 includes a locking cog 345 and a catch 350. The oblong aperture 340 includes a locking cog 355 and a catch 360.

Figure 10:
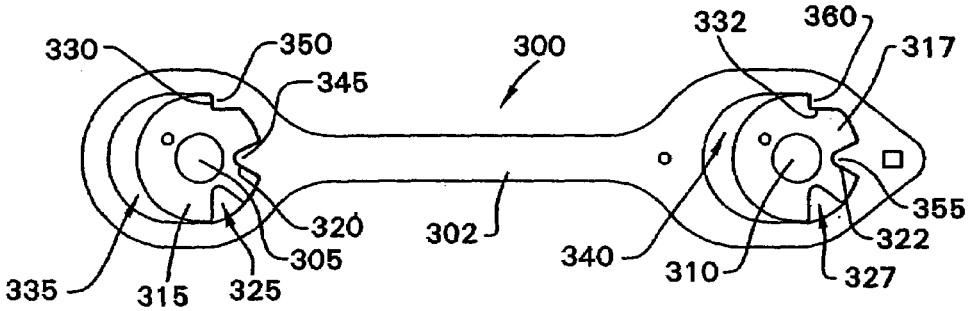
FIG. 10 is a side view of a locking system for a siderail support mechanism, in a locked position, according to a further embodiment of the invention.

As shown in FIG. 10, with the locking plate 302 in the locked position (biased to the left), the locking cogs 345, 355 are received in the first notches 320, 322. The catches 350, 360 are each received in the cutout sections 330, 332 of the respective collar 315, 317. This is the "upright" position for the first and second lower pivot shafts 305, 310.

Figure 11:
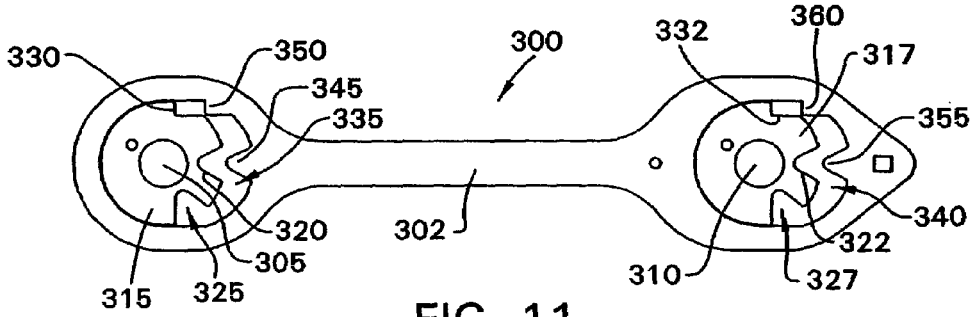
FIG. 11 is a side view of the locking mechanism of FIG. 10 in an unlocked position.
Figure 12:
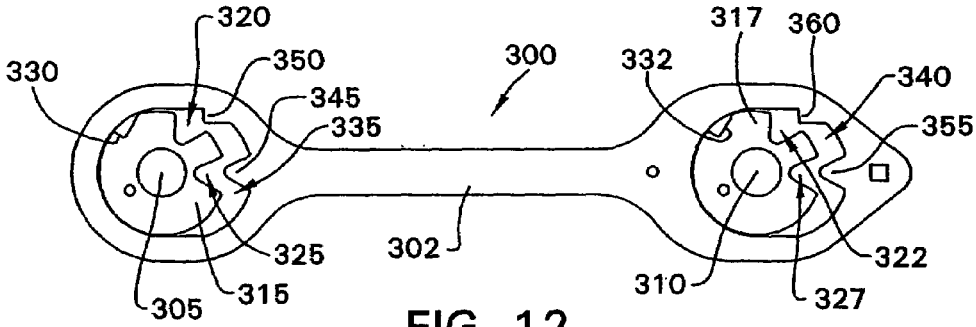
FIG. 12 is a side view of the locking mechanism of FIGS. 10–11 in the intermediate height unlocked position.

Referring to FIGS. 11–12, the locking plate 302 has been moved to the right so that the locking cogs 345, 355 are extracted from the notches 320, 322 and the catches 350, 360 are withdrawn from the cutout sections 330, 332. The lower pivot shafts 305, 310 are thus free to rotate. FIG. 11 shows the locking plate 302 shifted to the left with the lower pivot shafts 305, 310 still in the upright position. FIG. 12 shows the lower pivot shafts 305, 310, and the collars 315, 317, rotated to a secondary deployed position. In the secondary position of FIG. 12, the second notches 325, 327 have been rotated into alignment with the locking cogs 345, 355. The first notches 320, 322 have been rotated into alignment with the catches 350, 360.

Figure 13:
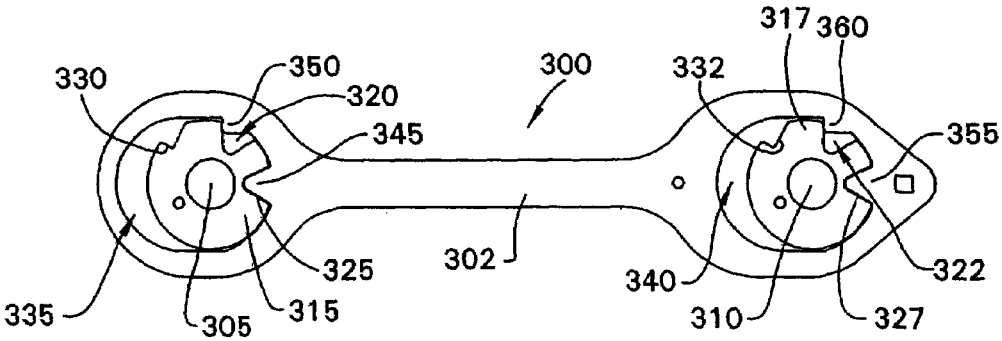
FIG. 13 is a side view of the locking mechanism of FIGS. 10–12 in the intermediate height locked position.

Referring now to FIG. 13, the locking plate 302 has been released to the left. The locking cogs 345, 355 are received in the second notches 325, 327. The catches 350, 360 have been received in notches 320, 322. The siderail support mechanism 300 is thereby locked in the secondary deployed position.

Figure 14:
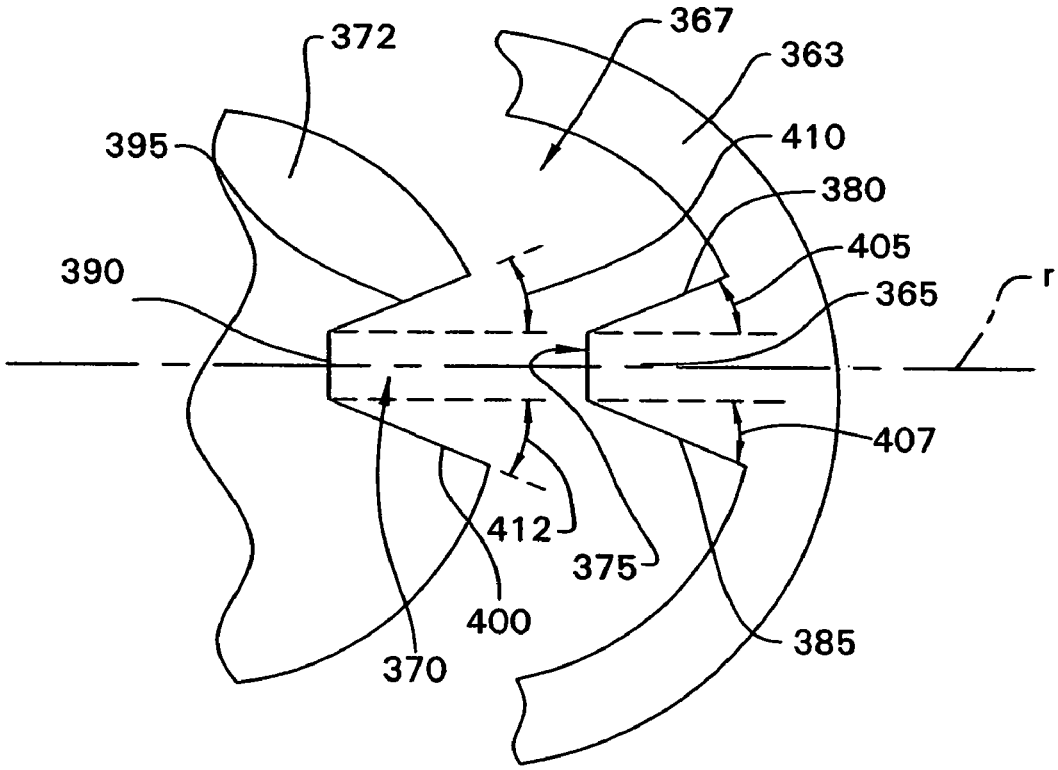
FIG. 14 is a partial cut-away view of a locking cog and receiving notch adaptable for the embodiments of FIGS. 1–13.

FIG. 14 is an enlarged partial view of a locking plate 363 having a locking cog 365, the locking cog 365 projecting into an oblong aperture 367 of the locking plate 363 as previously described. A notch 370 corresponding to the locking cog 365 is formed in a collar 372, although the notch 370 could also be formed directly in a lower pivot shaft as described above in the first embodiment of the invention.

The locking cog 365 includes an anterior face 375 and a pair of lateral faces 380, 385. The notch 370 includes a base 390 and a pair of side walls 395, 400. As shown in FIG. 14, the lateral faces 380, 385 of locking cog 365 are non-parallel and are not parallel to a radius r perpendicular to the anterior face 375 of the locking cog 365. Each of the lateral faces 380, 385 of the locking cog 365 is splayed outward at a respective angle 405, 407 from the perpendicular. The angles 405, 407 define a total inclusive angle preferably in the range of 8 degrees to 24.9 degrees, and are preferably equivalent, although the angles 405, 407 can be alternately configured for different operating characteristics. The notch 370 of the collar 372 is similarly configured such that the sidewalls 395, 400 are non-parallel and are splayed outward at a respective angle 410, 412. The notch 370 is configured to operatively cooperate with the locking cog 365. In a preferred embodiment, the angle 410 is substantially equivalent to the angle 405 and the angle 412 is substantially equivalent to the angle 407.

By placing the lateral faces 380, 385 at the respective angle 405, 407, and the side walls 395, 400 at the respective angle 410, 412, the siderail support mechanism is adapted to positively lock the siderail in an upright deployed position, but to collapse upon an impact of the siderail with a stationary barrier, such as with a doorjamb, as the bed is being moved. That is, the torque applied to the collars 372, caused by the siderail engaging the stationary barrier, will initiate a relative sliding movement between the opposing surface pairs 385, 400 and 380, 395 because of the angularity relationship of these surfaces to each other and to the radius r. The patient is thereby secured in the bed, and the collapsing feature reduces the jarring of the patient while being transported in the bed, and further prevents the destruction of the siderail support mechanism.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A siderail support mechanism comprising: a mounting bracket having a first lower pivot and a second lower pivot, the mounting bracket configured for mounting to a bed;

a first support arm having a first upper pivot shaft and a first lower pivot shaft, the first upper pivot shaft configured to pivotally attach to a siderail at a first upper pivot and the first lower pivot shaft configured to pivotally attach to the first lower pivot of the mounting bracket;

a second support arm having a second upper pivot shaft and a second lower pivot shaft, the second upper pivot shaft configured to pivotally attach to the siderail at a second upper pivot and the second lower pivot shaft configured to pivotally attach to the second lower pivot of the mounting bracket;

a plurality of circumferentially spaced notches formed about the first lower pivot shaft;

a plurality of circumferentially spaced notches formed about the second lower pivot shaft;

a locking plate having a first oblong aperture for receiving the first lower pivot shaft and a second oblong aperture for receiving the second lower pivot shaft;

a first locking cog extending into the first oblong aperture and configured for entry into one of the plurality of notches formed about the first lower pivot shaft;

a second locking cog extending into the second oblong aperture and configured for entry into one of the plurality of notches formed about the second lower pivot shaft; and a spring for biasing the locking plate to urge the first and second locking cogs into the respective notches formed about the first and second lower pivot shafts.

2. The siderail support mechanism of claim 1, further comprising a collar mounted about the second lower pivot shaft, wherein the circumferentially spaced notches are formed in the collar.

3. The siderail support mechanism of claim 2, further comprising a collar mounted about the first lower pivot shaft, wherein the circumferentially spaced notches are formed in the collar.

4. The siderail support mechanism of claim 1, wherein at least one of the first locking cog and the second locking cog comprises non-parallel lateral faces.

5. The siderail support mechanism of claim 4, wherein at least one of the circumferentially spaced notches comprises non-parallel sidewalls.

6. The siderail support mechanism of claim 4, wherein the non-parallel lateral faces define an inclusive angle in the range of 8 degrees and 24.9 degrees.

7. The siderail support mechanism of claim 1, wherein at least one of the circumferentially spaced notches comprises non-parallel sidewalls.

8. The siderail support mechanism of claim 1, wherein the first locking cog comprises an anterior face, and a pair of lateral faces, the lateral faces intersecting the anterior face at a non-perpendicular angle.

9. The siderail support mechanism of claim 8, wherein at least one of the plurality of notches formed about the first lower pivot shaft comprises sidewalls parallel with the corresponding lateral faces of the first locking cog.

10. The siderail support mechanism of claim 9 wherein the lateral faces of the first locking cog describe an inclusive angle between 8 degrees and 24.9 degrees.

11. The siderail support mechanism of claim 1, wherein at least one of circumferentially spaced notches formed about the first lower pivot shaft comprises a cut-out, and the first oblong aperture further comprises a catch configured for-engaging the cut-out.

12. The siderail support mechanism of claim 11, wherein at least one of circumferentially spaced notches formed about the second lower pivot shaft comprises a cut-out, and the second oblong aperture further comprises a catch configured for engaging the cut-out.

13. The siderail support mechanism of claim 1, wherein a first of the plurality of notches formed about the first lower pivot shaft is arranged to cooperate with the first locking cog to hold the first support arm in a vertical deployed position.

14. The siderail support mechanism of claim 13, wherein a second of the plurality of notches formed about the first lower pivot shaft is arranged to cooperate with the first locking cog to hold the first support arm in a non-vertical deployed position.

15. The siderail support mechanism of claim 1, further comprising a bypass plate configured to prevent the locking plate from sliding into a locked position when the siderail has been placed in a fully stowed position.

16. The siderail support mechanism of claim 1, further comprising a toggle mounted on each of the first and second lower pivot shafts and a synchronization link connecting the toggles to coordinate rotation of the first and second lower pivot shafts.

17. A siderail support mechanism comprising:

a mounting bracket having a first lower pivot and a second lower pivot, the mounting bracket configured for mounting to a bed;

a first support arm having a first upper pivot shaft and a first lower pivot shaft, the first upper pivot shaft configured to pivotally attach to a siderail at a first upper pivot and the first lower pivot shaft configured to pivotally attach to the first lower pivot of the mounting bracket;

a second support arm having a second upper pivot shaft and a second lower pivot shaft, the second upper pivot shaft configured to pivotally attach to the siderail at a second upper pivot and the second lower pivot shaft configured to pivotally attach to the second lower pivot of the mounting bracket;

a plurality of circumferentially spaced notches formed about the first lower pivot shaft;

a locking plate having an oblong aperture for receiving the first lower pivot shaft;

first and second projections extending into the oblong aperture for engaging two of the plurality of circumferentially spaced notches formed about the first lower pivot shaft; and a spring for biasing the locking plate to urge the first and second projections into the circumferentially spaced notches formed about the first lower pivot shaft.

18. The siderail support mechanism of claim 17, wherein the locking plate further comprises a second oblong aperture for receiving the second lower pivot shaft.

19. The siderail support mechanism of claim 18, further comprising a plurality of circumferentially spaced notches formed about the second lower pivot shaft, and a third projection extending into the second oblong aperture for engaging one of the circumferentially spaced notches formed about the second lower pivot shaft.

20. The siderail support mechanism of claim 19, further comprising a fourth projection extending into the second oblong aperture for engaging a second one of the plurality of circumferentially spaced notches formed about the second lower pivot shaft.

21. The siderail support mechanism of claim 17, further comprising a collar mounted about the first lower pivot shaft, wherein the circumferentially spaced notches are formed in the collar.

22. The siderail support mechanism of claim 17, wherein at least one of the first and second projections comprises non-parallel lateral faces.

23. The siderail support mechanism of claim 22, wherein at least one of the circumferentially spaced notches comprises non-parallel sidewalls.

24. The siderail support mechanism of claim 17, wherein at least one of the circumferentially spaced notches comprises non-parallel sidewalls.

25. The siderail support mechanism of claim 17, wherein at least one of the first and second projections comprises an anterior face, and a pair of lateral faces, the lateral faces intersecting the anterior face at a non-perpendicular angle.

26. The siderail support mechanism of claim 25, wherein the lateral faces of the at least one projection describe an inclusive angle between 8 degrees and 24.9 degrees.

27. A siderail support mechanism comprising:

a mounting bracket having a first lower pivot and a second lower pivot, the mounting bracket configured for mounting to a bed;

a first support arm having a first upper pivot shaft and a first lower pivot shaft, the first upper pivot shaft configured to pivotally attach to a siderail at a first upper pivot and the first lower pivot shaft configured to pivotally attach to the first lower pivot of the mounting bracket;

a second support arm having a second upper pivot shaft and a second lower pivot shaft, the second upper pivot shaft configured to pivotally attach to the siderail at a second upper pivot and the second lower pivot shaft configured to pivotally attach to the second lower pivot of the mounting bracket;

a plurality of circumferentially spaced notches formed about the first lower pivot shaft;

a locking plate having a first oblong aperture for receiving the first lower pivot shaft;

a first locking cog extending into the first oblong aperture and configured for entry into one of the plurality of notches formed about the first lower pivot shaft, the first locking cog comprising non-parallel lateral faces; and a spring for biasing the locking plate to urge the locking cog into one of the circumferentially spaced notches formed about the first lower pivot shaft.

28. The siderail support mechanism of claim 27, wherein the locking plate further comprises a second oblong aperture for receiving the second lower pivot shaft.

29. The siderail support mechanism of claim 28, further comprising a plurality of circumferentially spaced notches formed about the second lower pivot shaft, and a second locking cog extending into the second oblong aperture and configured for entry into one of the plurality of notches formed about the second lower pivot shaft.

30. The siderail support mechanism of claim 29, wherein the second locking cog comprises non-parallel lateral faces.

31. The siderail support mechanism of claim 30, wherein at least one of the circumferentially spaced notches formed about the second lower pivot shaft comprises non-parallel sidewalls.

32. The siderail support mechanism of claim 31, wherein the lateral faces of the second locking cog are parallel with the corresponding sidewalls of the at least one notch.

33. The siderail support mechanism of claim 32 wherein the lateral faces of the second locking cog describe an inclusive angle between 8 degrees and 24.9 degrees.

34. The siderail support mechanism of claim 27, wherein at least one of the circumferentially spaced notches formed about the first lower pivot shaft comprises non-parallel sidewalls.

35. The siderail support mechanism of claim 34, wherein the lateral faces of the first locking cog are parallel with the corresponding sidewalls of the at least one notch.

36. The siderail support mechanism of claim 34 wherein the lateral faces of the first locking cog describe an inclusive angle between 8 degrees and 24.9 degrees.

37. The siderail support mechanism of claim 27, wherein the first locking cog comprises an anterior face and at least one of the lateral faces intersects the anterior face at a non-perpendicular angle.

38. The siderail support mechanism of claim 37 wherein the lateral faces of the first locking cog describe an inclusive angle between 8 degrees and 24.9 degrees.

39. The siderail support mechanism of claim 27 wherein the lateral faces of the first locking cog describe an inclusive angle between 8 degrees and 24.9 degrees.

* * * * *

UNITED STATES PATENT AND TRADEMARK OFFICE

CERTIFICATE OF CORRECTION

PATENT NO. : 7,107,637 B2
APPLICATION NO. : 11/034263
DATED : September 19, 2006
INVENTOR(S) : Devin W. Kuek et al.

It is certified that error appears in the above-identified patent and that said Letters Patent is hereby corrected as shown below:

On the title page, item (75) and in Column 1; change the address of Devin W. Kuek from "Kalamazoo, MI" to --Indianapolis, IN--.

Column 7, lines 59 & 60; change "for-engaging" to --for engaging--.

Signed and Sealed this

Second Day of January, 2007

JON W. DUDAS
*Director of the United States Patent and Trademark Office*